US005609137A

United States Patent [19]

Rembold et al.

[11] Patent Number: 5,609,137

[45] Date of Patent: Mar. 11, 1997

[54] FUEL INJECTION APPARATUS FOR A TWO-STROKE INTERNAL COMBUSTION ENGINE

[75] Inventors: Helmut Rembold, Stuttgart; Gottlob Haag, Markgroningen; Heinz Britsch, Bietigheim-Bissingen; Heinz Stutzenberger, Vaihingen; Uwe Mueller, Korntal-Munchingen, all of Germany

[73] Assignee: Robert Bosch GmbH, Stuttgart, Germany

[21] Appl. No.: 648,037

[22] PCT Filed: Aug. 11, 1995

[86] PCT No.: PCT/DE95/01063

§ 371 Date: May 14, 1996

§ 102(e) Date: May 14, 1996

[87] PCT Pub. No.: WO96/08644

PCT Pub. Date: Mar. 21, 1996

[30] Foreign Application Priority Data

Sep. 14, 1994 [DE] Germany ..... 44 32 635.1

[51] Int. Cl.[6] ..... F02D 1/06; F02M 69/10

[52] U.S. Cl. ..... 123/382; 123/73 C

[58] Field of Search ..... 123/382, 383, 123/73 C, 73 CB

[56] References Cited

U.S. PATENT DOCUMENTS

| | | | |
|---|---|---|---|
| 2,093,984 | 9/1937 | Schweizer et al. | 123/382 |
| 3,795,233 | 3/1974 | Crews et al. | 123/383 |
| 4,700,668 | 10/1987 | Schierling et al. | 123/73 C |
| 4,813,391 | 3/1989 | Geyer et al. | 123/73 C |
| 4,932,370 | 6/1990 | Schierling et al. | 123/73 C |
| 4,969,436 | 11/1990 | Hartmann et al. | 123/383 |

*Primary Examiner*—Marguerite McMahon

*Attorney, Agent, or Firm*—Edwin E. Greigg; Ronald E. Greigg

[57] ABSTRACT

A fuel injection apparatus of the invention for a two-stroke engine including a fuel injection with an adjusting device, which via a pulsating pressure line is supplied with the pulsating internal pressure and inner chamber of a crankcase of the two-stroke engine, so as to meter the supply quantity of the fuel injection pump as a function of the internal pressure in such a way that exhaust emissions and fuel consumption of the two-stroke engine are reduced by means of a supply quantity optimally adapted to the combustion. The fuel injection apparatus according to the invention is intended for use in two-stroke engines.

8 Claims, 4 Drawing Sheets

FUEL INJECTION APPARATUS FOR A TWO-STROKE INTERNAL COMBUSTION ENGINE

BACKGROUND OF THE INVENTION

The invention is based on a fuel injection apparatus for a two-stroke internal combustion engine.

A fuel injection apparatus for a two-stroke internal combustion engine is already known (offprint from MTZ, Motortechnische Zeitschrift [Automotive Engineering Journal], 13th year, No. 10, Oct. 1952), in which a fuel injection pump pumps fuel to a fuel injection valve that injects fuel directly into a combustion chamber of the two-stroke engine. The fuel injection pump is embodied as a so-called in-line pump, in which each cylinder of the two-stroke engine is supplied with fuel via a separate pump element. The pump element is composed of a pump piston and a pump cylinder. The pump piston is guided longitudinally displaceably in the pump cylinder and is driven via a drive element by a camshaft of the two-stroke engine. For controlling the performance of the two-stroke engine, a throttle valve rotatably supported in a throttle valve neck is actuated; to that a rod linkage is provided on the throttle valve, the linkage being connected to a gas pedal or a gas lever. In operation of the two-stroke engine, a certain negative pressure is established in the throttle valve neck; this pressure depends on the rotary position of the throttle valve, so that it can be utilized to regulate the supply quantity of the fuel injection pump. In this prior art, the negative pressure is drawn off downstream of the throttle valve and carried via a pulsating pressure line to an adjusting device. The adjusting device is part of the fuel injection pump, and as a function of the negative pressure prevailing in the throttle valve neck it regulates the supply quantity of the fuel injection pump. To vary the supply quantity, the pump piston is rotated, and includes a face which has a recess on its outer jacket in the form of an obliquely extending control edge. By means of the control edge, the pump piston controls a control bore that is in the pump cylinder and discharges into a pump work chamber of the pump piston; the rotary position of the control edge relative to the control bore determines the end of pumping by the pump piston. The useful stroke and thus the supply quantity are varies by means of the location of the pump piston in the pump cylinder.

For rotating the pump piston, a sleevelike control element is provided, the interior of which has an opening with two longitudinal slits; a slaving device embodied on the pump piston, for instance in the form of a piston lug, glides axially displaceably on the longitudinal slits and engages them, so as to rotate the pump piston only when a rotation of the control element occurs. For its actuation, the control element has a toothed segment, which for instance is clamped onto its outer surface and with which a control rod, accommodated crosswise to a longitudinal axis of the pump piston in the housing of the fuel injection pump, meshes with outer teeth, so as to cause a rotation of the control element and pump piston upon a longitudinal displacement of the control rod. In the prior art in question, the control rod is mounted by one end on a diaphragm of an adjusting device, which as a function of the negative pressure in the throttle valve neck determines the supply quantity of the fuel injection pump. To that end, the diaphragm of the adjusting device divides two pressure chambers from one another in pressure-tight fashion, that is, a connection pressure chamber and an adjusting pressure chamber, so that if there is a pressure difference between the connection pressure chamber and the adjusting pressure chamber, the diaphragm is moved in the direction of the pressure drop. As the diaphragm moves, the control rod mounted on the diaphragm is displaced, and at the same time the control element is rotated in order to effect an adjustment of the supply quantity of the fuel injection pump. In this prior art, the adjusting pressure chamber is acted upon by ambient pressure and the connection pressure chamber is acted upon by negative pressure of the throttle valve neck, so that depending on the pressure difference present at the diaphragm, a displacement of the control rod and via the control element a rotation of the pump piston takes place.

In regulating the performance of the two-stroke engine as described by means of a negative pressure in the throttle valve neck, however, it is possible only at extremely inconvenience to adapt the supply quantity to varying operating parameters of the two-stroke engine. Doing so requires additional devices. For instance, the influence of the ambient pressure, which decreases with increasing geodetic altitude and thus a decreasing air fill in the cylinders of the two-stroke engine, can be ascertained only by means of an additional altitude pressure sensor. The influence of the temperature of the air aspirated by the two-stroke engine can also be detected only by means of a temperature sensor that being connected with the fuel injection pumps suitably adapts the supply quantity to the air temperature. Typically, the temperature sensor is accommodated outside the fuel injection pump in the throttle valve neck. The temperature sensor is connected by means of a rod linkage to the fuel injection pump control rod, in order to actuate it in compensating fashion as a function of the temperature of the aspirated air, so that an adaptation of the supply quantity to variable aspirated air temperatures takes place.

Advantages of the Invention

The fuel injection apparatus according to the invention has the advantage over the prior art that in a simple way, an adaptation of the supply quantity of the fuel injection pump to varying operating parameters of the two-stroke engine is accomplished; in particular, the proportions of polluting exhaust gas components and fuel consumption of the two-stroke engine drop markedly.

By means of the provisions recited herein, advantageous further features of and improvements to the fuel injection apparatus disclosed are possible. Advantageously, a starter device that can be turned on upon cold starting of the two-stroke engine makes a further reduction in polluting exhaust gas components possible.

BRIEF DESCRIPTION OF THE DRAWINGS

Exemplary embodiments of the invention are shown in simplified form in the drawing and are explained in further detail in the ensuing description.

DETAILED DESCRIPTION OF THE EXEMPLARY EMBODIMENTS

Figure 1:
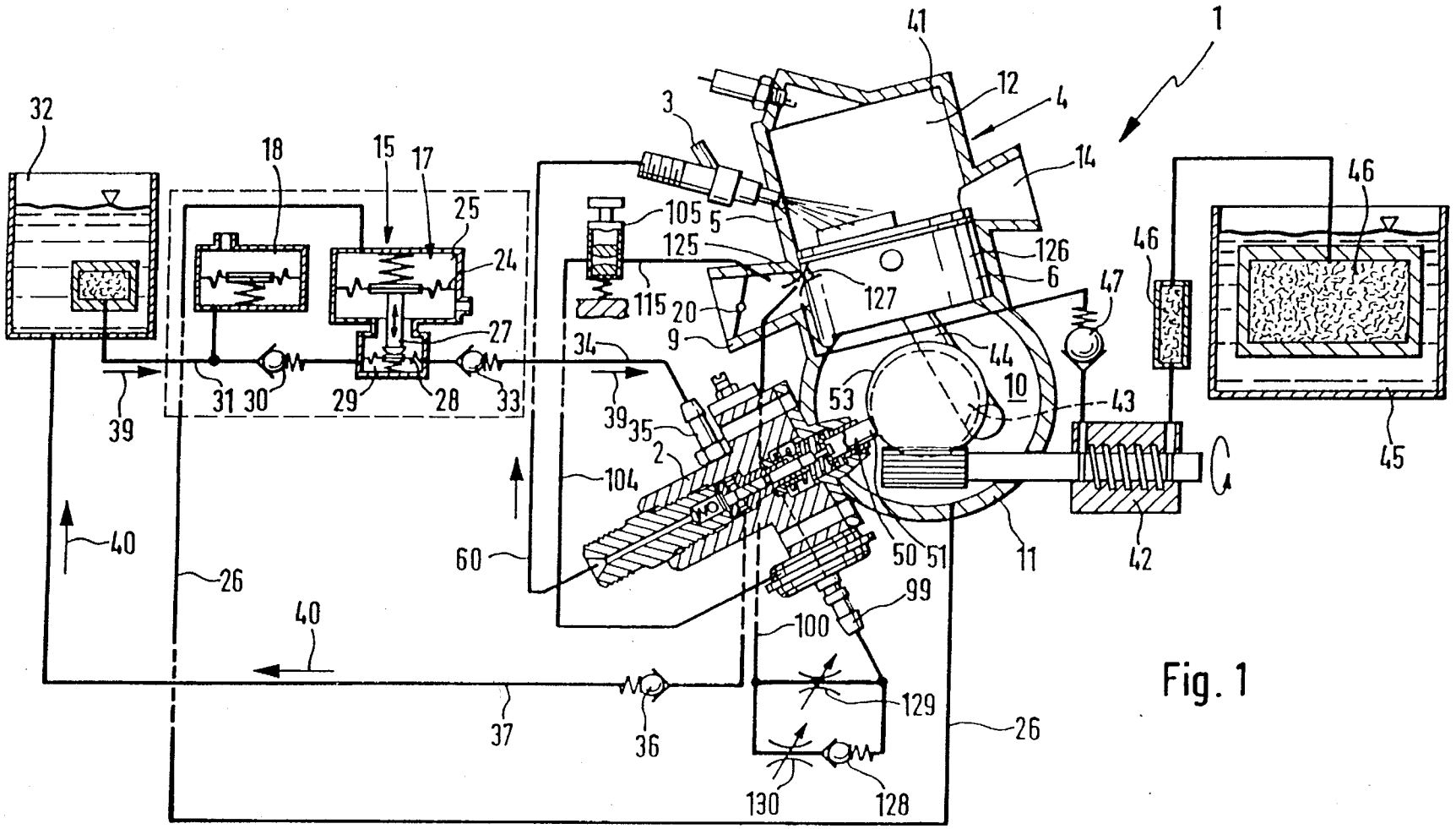
FIG. 1 is a schematic function diagram of a fuel injection apparatus according to the invention.

FIG. 1 shows a schematic function diagram of a fuel injection apparatus 1 according to the invention, in which a fuel injection pump 2 is provided for supplying fuel to a two-stroke internal combustion engine 4 shown in fragmentary form in section. The fuel injection pump 2 pumps fuel to a fuel injection valve 3, provided on a cylinder 5 of the two-stroke engine 4, that injects the fuel directly into a combustion chamber 12 of the two-stroke engine 4. In the process, via an intake tube 9, the two-stroke engine 4 aspirates the requisite air for combustion into an inner chamber 10 of a crankcase 11 of the two-stroke engine, from which the air flows, via overflow conduits not shown in further detail, into the combustion chamber 12 under the control of a piston 6 accommodated in displaceable fashion in the cylinder 5. The exhaust gases produced in combustion are removed from the combustion chamber 12 via an outlet conduit 14. By way of example, the two-stroke engine 4 is intended for driving hand-held power tools, such as power chainsaws, cutting-off grinders, shrub trimmers, and for driving mopeds, motorboats, and lawnmowers or the like. A fuel prefeed pump 15 furnishes fuel to the fuel injection pump 2 and is composed of a low-pressure pump part 17 and an intake buffer 18 preceding the low-pressure pump part 17, as shown inside a dashed lines in FIG. 1. The fuel prefeed pump 15 is driven by the internal pressure in the crankcase 11 of the two-stroke engine 4, which pulsates in the inner chamber 10 of the crankcase 11; to that end, a pressure line 26 is provided, which leads to the inner chamber 10 of the crankcase 11 from a work chamber 25, defined by a diaphragm 24, of the low-pressure pump part 17. The diaphragm 24, via a tappet 27, controls a pump diaphragm 28 that defines a pump chamber 29. The pump chamber 29 communicates via an intake valve 30 with a fuel inlet 31 that carries the fuel from a fuel tank 32. Via a pressure line 33 and a low-pressure line 34, the fuel is carried in the direction of the arrows 39 to a low-pressure connection 35 of the fuel injection pump 2; excess fuel pumped from the low-pressure pump part 17 flows back in a provided fuel return line 37, in the direction of the arrows 40, via a return valve 36 from the fuel injection pump 2 to the fuel tank 32.

The fuel injection pump 2 and the fuel injection valve 3 correspond in their basic design to known Diesel technology. Since the fuel is no longer introduced into the combustion chamber 12 via an otherwise typical carburetor into the intake tube 9 in the form of a fuel-air mixture mixed with oil but instead is injected directly into the combustion chamber 12 and therefore no longer comes into contact with an inner wall 41 of a cylinder of the two-stroke engine 4, a lubricant oil pump 42 is necessary. The lubricant oil pump 42 pumps oil to the crankshaft bearing, connecting rod bearing, and piston pin boss, and in particular to the inner wall 41 of the cylinder. By way of example, the lubricant oil pump 42 is driven by a crankshaft 43 of the two-stroke engine 4, which is shown in dashed lines in FIG. 1 and via a connecting rod 44 converts the up-and-down motion of the piston 6 into a rotary motion of the crankshaft 43. For pumping the oil, the lubricant oil pump 42 has a feed screw, which has bevel gearing, for instance, on its end. The bevel gearing meshes with spur gearing provided on the crankshaft 43, in order to pump the oil out of an oil tank 45 and oil filters 46, provided by way of example, via a pressure valve 47 by means of the feed screw.

Figure 2:
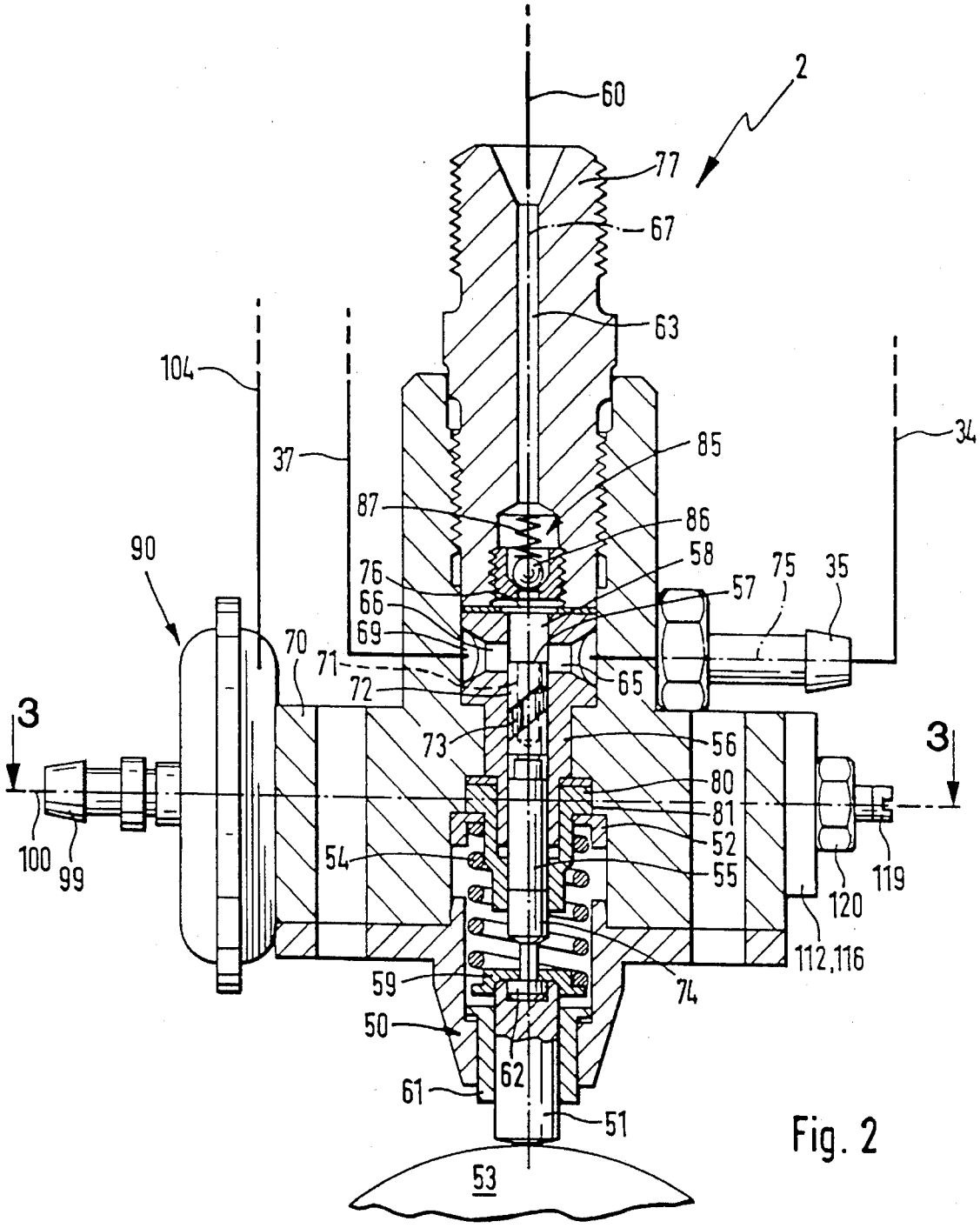
FIG. 2 is a section through a fuel injection pump of a first exemplary embodiment of the invention.

In the exemplary embodiments, the fuel injection pump 2 is embodied as a so-called plug-in injection pump. As shown in FIG. 2, one pump piston 55 and one pump cylinder 56 form a single pump element, which feeds the fuel to the two-stroke engine 4, which is embodied for instance with a single cylinder. It is also possible for the fuel injection pump to be of the so-called in-line pump type, in which a single pump element is provided for each cylinder, and the pump elements are disposed in line, i.e. one after the other, in a common housing. As shown in FIG. 1, the fuel injection pump 2 is driven in a known manner by a cam 53 mounted on the crankshaft 43, via a drive element 50 of the fuel injection 2. As shown in FIG. 2, the drive element 50 is composed of a tappet 51, which is longitudinally displaceable in a sleeve 61 and which via a spring plate 52 and a piston spring 54 is pressed against the cam 53 of the crankshaft 43, in order by the eccentric shape of the cam 53 to move the tappet 51 up and down. It is also possible by the shaping of the cam 53 to adjust the duration of fuel injection, the performance and speed of pumping of the fuel injection pump 2.

The tappet 51 drives the pump piston 55 in order to feed fuel via a feed line 60 to the fuel injection valve 3. To that end, the pump piston 55 is accommodated longitudinally displaceably in the pump cylinder 56 along a longitudinal axis 67 extending centrally through the pump piston 55, and with an end face 57 located in the pump cylinder 56 it defines pump work chamber 58 in the pump cylinder 56. The pump piston 55 is fitted into the pump cylinder 56 with the utmost precision, so that even at high pressures and low rpm of the two-stroke engine 4, the pump piston 55 remains tight, and no further seal is needed. On its lower end, the pump piston 55 is held freely rotatably on the tappet 51 via a headpiece 62; the piston spring 54, via the spring plate 52 retained on the pump cylinder 56, engages a head plate 59 in the region of its headpiece 52, so that the piston spring 54 is tensed in the working stroke of the pump piston 55. After the working stroke, the piston spring 54 returns the pump piston to its outset position; the piston spring 54 presses the tappet 51 permanently against the cam 53, so that the tappet does not lift away from or hop off the cam 53.

A control bore 65 and an outlet bore 66 discharge into the pump work chamber 58; these bores are made in the pump cylinder 56 and are aligned with one another along a control axis 75 that is oriented crosswise to the longitudinal axis 67. The pump cylinder 56 and the inner pump piston 55 are accommodated in a housing 70 of the fuel injection pump 2. From the low-pressure pump part 17 shown in FIG. 1, pumped fuel flows via the low-pressure connection 35 to the pump piston 55 shown in FIG. 2, into an annular chamber 69 located between the housing 70 and the pump cylinder 56 and from that chamber to the control bore 65. By way of example, the outlet bore 66 likewise communicates with the annular chamber 69 and the control bore 65, so that the fuel diverted upon pumping of the pump piston 55 can be fed, for example via an outlet connection on the housing 70, which connection is not identified by reference numeral but communicates with the outlet bore 66, into the fuel return line 37, in which the fuel flows back to the fuel tank 32. For diverting the fuel, the pump piston 55 has a bore 71, which is made centrally in the pump piston 55, and a control edge 73 recessed from a jacket face 72 of the pump piston 55. The control edge 73 is partially visible in FIG. 2 and is embodied by way of example as a so-called top-located control edge 73. The bore 71 extends from the end face 57 in the direction of the tappet 51, for example parallel to the longitudinal axis 67, as far as the control edge 73, which extends obliquely to the longitudinal axis 67.

The design and mode of operation of a fuel injection pump 2, operating with a pump piston 55 having a control edge 73 and control bore 65, is known to one skilled in the art of Diesel technology and will therefore be described only briefly below. The fuel flowing into the pump work chamber 58 via the control bore 65 is compressed by the pump piston 55 on its upward motion; a pressure valve 85 defining the pump work chamber 58 remains initially closed in the process. A compression spring 87 of the pressure valve 85 acts upon a valve closing body 86, embodied for instance as a ball, so that a connection 76 from the pump work chamber 58 to a feed bore 63, provided in a feed portion 77 of the fuel injection pump 2, is closed. After the onset of pumping by the pump piston 55, the valve closing member 86 opens, at a pressure that can be specified by the compression spring 87, and thus fuel from the pump work chamber 58 reaches the connection 76 and flows past the pressure valve 85 into the feed bore 63. Next, the fuel from the feed bore 63 flows into the feed line 60 connected to the feed bore 63 to the fuel injection valve 3.

The supply quantity of the fuel injection pump 2 can be adjusted by means of the rotary position of the control edge 73 of the pump piston 55 relative to the outlet bore 66; in a known manner, the control edge 73 controls the timing of the end of pumping of the fuel that has flowed into the pump work chamber 58 via the control bore 65, so that the pumping stroke of the pump piston 55 and thus the supply quantity can be adjusted by rotation of the pump piston 55, or in other words of the control edge 73. In the exemplary embodiment, the fuel injection pump 2 pumps fuel at a pressure of approximately 35 bar into the feed line 60 to the fuel injection valve 3.

For rotating the pump piston 55, a rotatable control element 80 is employed, which by way of example is embodied as a control sleeve partially surrounding the pump piston 55. The control element 80 is pressed against the pump cylinder 56 by the piston spring 54 and the spring plate 52. The connection of the control element 80 to the pump piston 55 is embodied such that an axial displaceability of the pump piston 55 is possible at all times, while conversely upon a rotation of the control element 80, a rotation of the pump piston 55 also ensues. To that end, two longitudinal slits, for example, are machined out of an inner wall of the control element 80, and in them a piston slaving device 74, a so-called piston lug, is guided axially slidingly; upon a rotation, it engages the longitudinal slits of the control element 80 in order to bring about a corresponding rotation of the pump piston 55.

Figure 3:
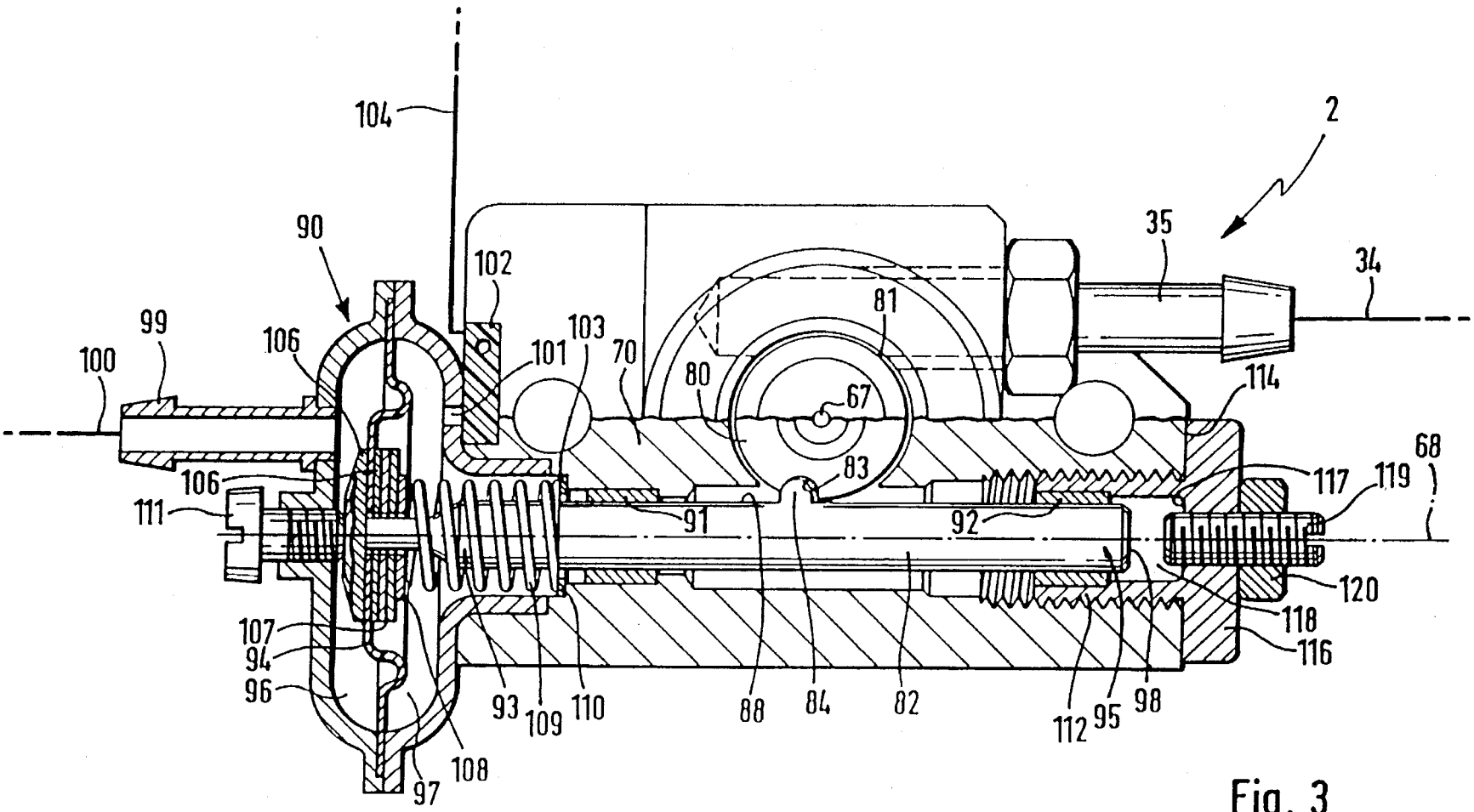
FIG. 3 is a section through the fuel injection pump taken along a line 3—3 of FIG. 2.

As shown in FIG. 3, which is the sectional view along a line 3—3 of FIG. 2, the control element 80 on its outer face 81 has an engagement groove 83, which extends into the plane of the drawing of FIG. 3 and for example extends at least partway in the direction of the longitudinal axis 67. The engagement groove 83 is engaged by an engagement body 84, which is connected to a control rod 82. The control rod 82 extends within the interior of the housing 70 of the fuel injection pump 2, offset from the control element 80, along a transverse axis 68 that extends crosswise to the longitudinal axis 67. By way of example, the engagement body 84 is embodied as a ball head or a pin, and it protrudes from an outer face 88 of the control rod 82. The engagement body 84 engages the engagement groove 83 of the control element 80, so as to cause a rotation of the control element 80 and the pump piston 55 upon a displacement of the control rod 82.

The control rod 82 is supported in the interior of the housing 70 of the fuel injection pump 2 by means of two bearings 91, 92, for instance slide bearings. In terms of the view of FIG. 3, the control rod 82 is secured by its left-hand end 93 to a diaphragm 94 of an adjusting device 90. The diaphragm 94 divides two pressure chambers from one another in pressure tight fashion. In the ensuing description, the pressure chamber shown on the left of the diaphragm 94 in FIG. 3 will be called the connection pressure chamber 96, and the pressure chamber shown on the right of the diaphragm 94 in FIG. 3 will be called the adjusting pressure chamber 97. The connection pressure chamber 96 communicates via a pulsating pressure connection 99 with a pulsating pressure line 100. By a connection not shown in FIG. 3, the adjusting pressure chamber 97 communicates for instance with the atmosphere, for instance via an opening 101 provided in the adjusting pressure chamber 97 and via a filter 102, provided at the opening 101, in the housing 70. As shown in the exemplary embodiment of FIG. 1, however, the opening 101 may also communicate via a connection, not identified by reference numeral, with a starting pressure line 104 that leads to a starter device 105, whose task and function will be described in further detail later in the description of the exemplary embodiment.

For joining the control rod 82 to the diaphragm 94, a connection piece 106 is mounted to both sides of the diaphragm 94; the connection piece is connected to an end piece, located in the adjusting pressure chamber 97, of the control rod 82. On a side of the connection piece 106 toward the control element 80, a pair 107 of bimetallic disks is provided which encompasses an end region of the control rod 82 and is pressed against the connection piece 106 by a spring plate 108 by means of a compression spring 109. The pair 107 of bimetallic disks is composed for instance of two joined-together metal disks which have different coefficients of thermal expansion. When the metal disks heat up, they bend, so that the compression spring 109 is compressed or in other words more heavily loaded. The compression spring 109 is braced on one side of the diaphragm 94 by the connection piece 106, via the spring plate 108 and the pair 107 of bimetallic disks, and on the opposite side is braced on a shoulder 103 via a support ring 110. The shoulder 103 is embodied in the adjusting pressure chamber 97 in the region of the bearing 91 shown on the left in FIG. 3. The diaphragm 94 is acted upon by the compression spring 109 in such a way that when the pressures in the connection pressure chamber 96 and the adjusting pressure chamber 97 are approximately equal, this spring rests, with the connection piece 106 located in the connection pressure chamber 96, against an idling adjusting screw 111 that protrudes into the connection pressure chamber 96.

When pressure of the connection pressure chamber 96, which is higher than the ambient pressure prevailing in the adjusting pressure chamber 97, is exerted, the diaphragm 94 is moved to the right in terms of FIG. 3, counter to the force of the compression spring 109, so that the connection piece 106 located in the connection chamber 96, lifts away from an end of the idling adjusting screw 111 protruding into the connection pressure chamber 96. With the diaphragm 94 in motion, the control rod 82 connected to the diaphragm 94 is shifted to the right; the engagement body 84 rotates the control element 80 counterclockwise and rotates the pump piston 55 shown in FIG. 2, in order thereby to increase the supply quantity of the fuel injection pump 2. If the pressure difference is negligible, the compression spring 109 displaces the diaphragm 94 so that the control rod 82 reaches its outset position again and the connection piece 106 rests on the idling adjusting screw 111. Screwing the idling adjusting screw 111 inward or outward therefore makes it possible to adjust the minimum supply quantity of the fuel injection pump 2, or to adjust the idling rpm of the two-stroke engine.

The second bearing 92 is accommodated in the housing 70 of the fuel injection pump 2, on an end 95 shown on the right in FIG. 3 of the control rod 82, and is retained by a screwable bearing sleeve 112. To that end, the bearing sleeve 112 has a male thread on its outer face so that it can be screwed firmly to the housing into a female thread of the housing 70 that extends from an end face 114 of the housing 70 in the direction of the control element 80 past the bearing 92. In the screwed-in state of the bearing sleeve 112, a closure piece 116 of the bearing piece 112 rests on the end face 114 of the housing 70; an axial clearance 118 remains between the end 95, shown on the right in FIG. 3, of the control rod 82 and an inner wall 117, toward the control rod 82, of the bearing sleeve 112. The axial clearance 118 is necessary to enable motion of the control rod 82 along the transverse axis 68. Protruding into the clearance 118 is an adjusting screw 119, screwed into the thread of the closure piece 116 of the bearing bush 112; this screw is retained in a manner secure against relative rotation by a lock nut 120 on the closure piece 116 of the bearing sleeve 112. The adjusting screw 119 is provided in order to limit a maximum displacement of the control rod 82 in the direction of the transverse axis 68 that occurs upon maximum imposition of pressure in the connection pressure chamber 96. When maximum pressure is imposed in the connection pressure chamber 96, the control rod 82 is shifted to the right in terms of FIGS. 3 and 4, until with an end face 98 on its right-hand end 95 the control rod 82 meets the adjusting screw 119, so that by screwing the adjusting screw 119 in or out, the maximum displaceable travel of the control rod 82, the maximum rotation of the control rod 80 and thus a maximum supply quantity of the fuel injection 2 can be established.

Heating up of the pair 107 of bimetallic disks shortens the fastened length of the compression spring 109, resulting in an increased spring force of the compression spring 109; hence a greater pressure difference between the overpressure in the connection pressure chamber 96 and the ambient pressure in the adjusting pressure chamber 97 is necessary in order to displace the control rod 82. If there is a rising temperature in the connection pressure chamber 96, for instance from a temperature increase in the inner chamber 10 of the crankcase 11 (FIG. 1), or a rising temperature in the adjusting pressure chamber 97, for instance from a rising ambient temperature, the pair 107 of bimetallic disks causes a reduced displacement of the control rod 82, while the pressure difference in the connection pressure chamber 96 and adjusting pressure chamber 97 remains constant, so that correspondingly less fuel is pumped by the fuel injection pump 2 to the fuel injection valve 3.

Figure 4:
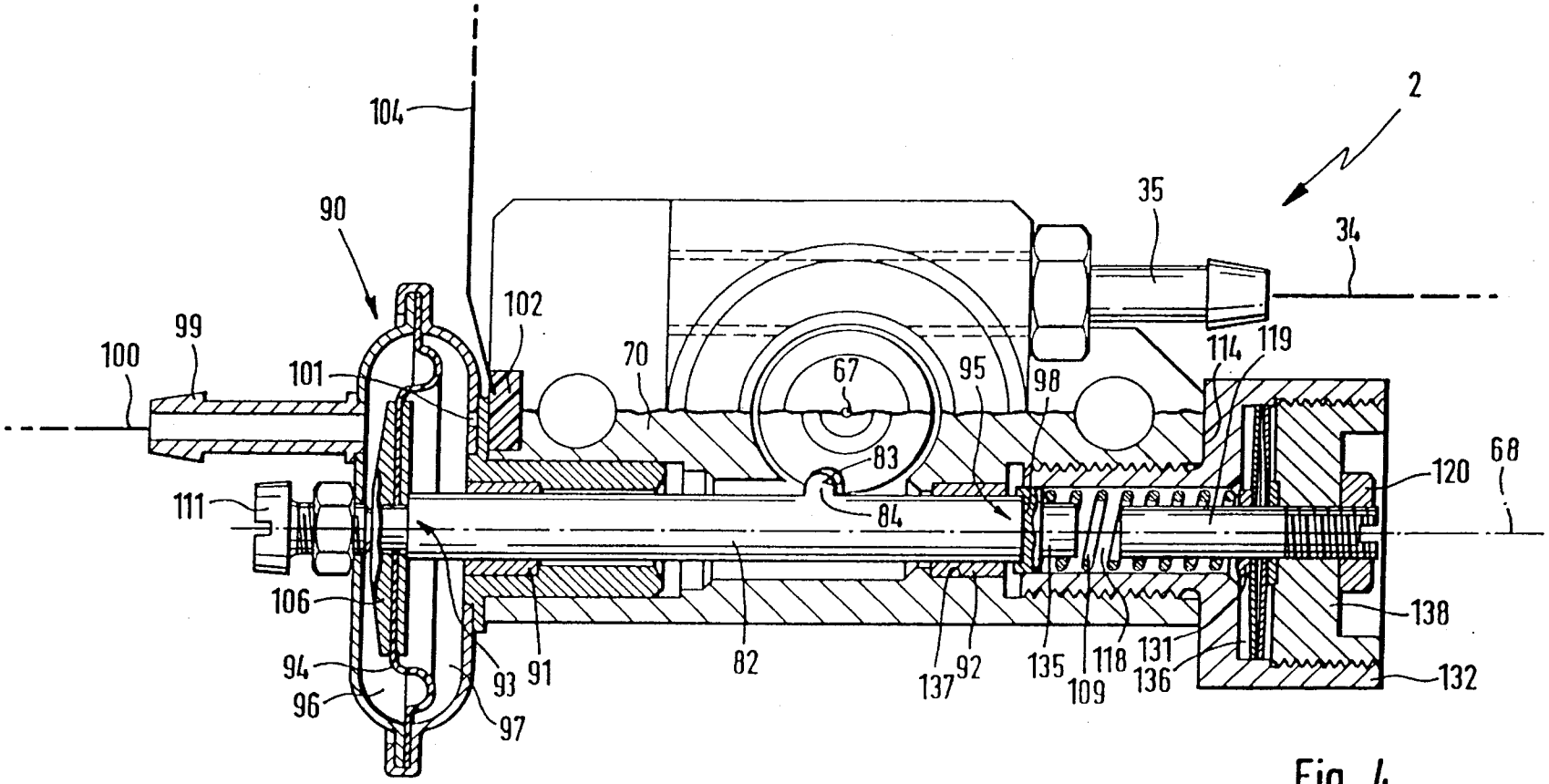
FIG. 4 is a section through the fuel injection pump in accordance with a second exemplary embodiment of the invention.

The adjusting pressure chamber 97 shown in FIGS. 3 and 4 communicates in the exemplary embodiment with the starter device 105 shown in FIG. 1 by means of a connection, not identified by reference numeral, on the housing 70 of the fuel injection 2. The starter device 105 is connected to the intake tube 9 downstream of a throttle valve 20 via a connection pressure line 115. The throttle valve 20 serves in a known manner to regulate the performance of the engine 4 and is supported in the intake tube 9 so as to be pivotable about a shaft. The throttle valve 20 can for instance be actuated by means of a rod linkage not identified by reference numeral that is connected for example to a gas pedal or a gas lever. The starter device 105 is turned on manually, for instance, only in the cold starting phase of the two-stroke engine 4, so as to carry the negative pressure, established in the intake tube 9 in operation of the two-stroke engine 4, to the starter device 105 via the connection pressure line 115 and from the starter device, via the starting pressure line 104, to the adjusting pressure chamber 97 of the adjusting device 90. By means of the negative pressure that prevails instead of the ambient pressure in the adjusting pressure chamber 97, there is consequently a greater pressure difference between the overpressure and the connection pressure chamber 96 and a negative pressure in the adjusting pressure chamber 97; as a result, the control rod 82 is deflected more sharply, so that when the starter device 105 is actuated, the supply quantity of the fuel injection pump 2 is increased. After the heating of the two-stroke engine 4 that ensues in operation, the starter device 105 can be turned off again. When the starter device 105 is turned off, the starting pressure line 104 is switched to the atmosphere, so that ambient pressure is again established in the adjusting pressure chamber 97, which reduces the supply quantity of the fuel injection pump 2 after the cold starting phase.

As shown in FIG. 1, the pulsating pressure line 100 leads to a control opening 125. The control opening 125 is recessed out of the inner wall 41 of the cylinder 5. Corresponding with the control opening 125, a piston opening 127 is recessed out from a circumferential wall 126 of the piston 6 and communicates with the inner chamber 10 of the crankcase 11. At a certain position of the piston 6 in the cylinder 5, the control opening 125 and the piston opening 127 open into one another, so that the internal pressure in the inner chamber 10 of the crankcase 11 is carried via the pulsating pressure line 100 to the connection pressure chamber 96 of the adjusting device 90. Since upon the outward motion in the direction of top dead center (TDC), the piston 6 generates a negative pressure in the inner chamber 10 of the crankcase 11 that is not meant to be carried to the connection pressure chamber 96, a valve 128 is required, which cuts off the negative pressure portion of the pulsating internal pressure in the crankcase 11. The valve 128 is disposed in the pulsating pressure line 100, for instance, and if there is overpressure in the pulsating pressure line 100 it assumes an open position, in the downward motion of the piston 6 toward bottom dead center (BDC), and otherwise this valve is closed. By a suitable choice of the location of the control opening 125 in the cylinder 5, a certain range of the internal pressure in the crankcase 11 can be chosen, such as 15° to 60° before reaching bottom dead center (BDC) of the piston 6, and carried via the control opening 125 and the pulsation line 100 the connection pressure chamber 96. The overpressure of the crankcase 11 carried to the connection pressure chamber 96 is higher than the ambient pressure in the adjusting pressure chamber 97, so that the diaphragm 94 of the adjusting device 90 is moved in the direction of the pressure drop. The moving diaphragm 94 displaces the control rod 82, toward the right in terms of FIGS. 3 and 4, whereupon the control element 80 is rotated. By means of a throttle 129 connected parallel to the valve 128, the throttle for instance regulating the pressure in the pulsating pressure line 100, and by means of a second throttle 130 connected upstream of the valve 128, fine metering of the supply quantity of the fuel injection pump 2 can be carried out. Since only the pressure difference between the overpressure in the crankcase 11 and the ambient pressure is used to control the supply quantity of the fuel injection pump 2, the influence of a varying ambient pressure, for instance from a change in geodetic altitude, can be compensated for by a corresponding variation in the supply quantity of the fuel injection pump 2. The choice of the location of the control opening 125 in the cylinder 5, or of the location of the correspondingly disposed piston opening 127, must be done in such a way that an internal pressure in the crankcase 11 that characterizes wide operating ranges of the two-stroke engine 4 is found, at which internal pressure, because of the always optimally adapted supply quantity of the fuel injection pump 2, unobjectionable operation of the two-stroke engine 4 with optimal combustion and only slight exhaust emissions is possible. It has been demonstrated that this is possible with a control opening 125 that is recessed out of the inner wall 41 of the cylinder approximately in the circumferential region of the intake tube 9. It is optimally also advantageous to provide a plurality of control openings at various locations on the inner wall 41 of the cylinder, which by way of example are disposed along a common line, so that they can be triggered by a common piston opening or by a plurality of piston openings. It is also conceivable to provide a plurality of control openings in the inner wall 41 of the cylinder that can be triggered some of them at the same time or in succession by correspondingly provided piston openings.

FIG. 4 shows a second exemplary embodiment according to the invention of the fuel injection apparatus 1 with the fuel injection pump 2; all elements that are the same or function the same are identified by the same reference numerals as in FIGS. 1–3. Unlike the first exemplary embodiment in FIG. 3, in FIG. 4 the compression spring 109 is accommodated in the region of the right-hand end 95 of the control rod 82. Without using the bearings 112 of the first exemplary embodiment, the right-hand bearing 92 is accommodated in a bearing recess 137 provided in the housing 70. A spring plate 135 on which the compression spring 109 is supported is connected to the right-hand end 95 of the control rod 82. The compression spring 109 is accommodated in a stepped sleeve 132, which is screwed with a male thread into a female thread extending from the end face 114 of the housing 70 of the fuel injection pump 2 as far as the right-hand bearing 92. The compression spring 109 surrounds part of the adjusting screw 119 accommodated in the sleeve 132 and is supported with a support ring 132 against the pair 107 of bimetallic disks, which unlike the first exemplary embodiment is accommodated in an inner chamber 136 formed by the sleeve 132 and by a screw-in part 138 of the sleeve 132. The pair 107 of bimetallic springs is supported against the screw-in part 138, which by way of example is screwed into the sleeve 132 by means of a female thread. The adjusting screw 119 is likewise screwed into a female thread provided on the screwed-in part 138 and is retained in a manner fixed against relative rotation by means of a lock nut 120. As in the first exemplary embodiment, a clearance 118, which enables displacement of the control rod 82, is present between the spring plate 135 and the adjusting screw 119. The clearance 118 can be varied by screwing the adjusting screw 119 in or out, so that the maximum displacement of the control rod 82 is adjustable by means of the adjusting screw 119.

The foregoing relates to preferred exemplary embodiments of the invention, it being understood that other variants and embodiments thereof are possible within the spirit and scope of the invention, the latter being defined by the appended claims.

We claim:

1. A fuel injection apparatus for a two-stroke internal combustion engine, comprising a fuel injection pump, said fuel infection pump includes a pump piston driven via a drive element by a crankshaft accommodated in a crankcase of the two-stroke engine and guided longitudinally in a pump cylinder, said pump piston includes an end face which defines a pump work chamber and a jacket face which has an obliquely extending control edge that controls the fuel pumped out of the pump work chamber to a fuel injection valve that injects the fuel directly into a combustion chamber of the two-stroke engine, a control element connected to the pump piston, said control element controls a supply quantity of the fuel injection pump being effected by rotating the pump piston, the control element being actuatable by an adjusting device via a control rod accommodated in a housing of the fuel injection pump and connected to the control element, the adjusting device includes a diaphragm which divides two pressure chambers from one another and to which the control rod is connected, the adjusting device (90) is acted upon by the internal pressure prevailing in the crankcase (11) of the two-stroke engine (2).

2. The fuel injection apparatus of claim 1, in which the adjusting device (90) can be connected via a pulsating pressure line (100) to a control opening (125) of a cylinder (5) of the two-stroke engine (4), the opening being made in an inner wall (41) of the cylinder, which control opening, upon coincidence with a piston opening (127) made in a circumferential wall (126) of a piston (6) of the two-stroke engine (4), the piston opening being open to the crankcase (11), intermittently establishes a pressure connection with the internal pressure in the crankcase (11).

3. The fuel injection apparatus of claim 2, in which in the pulsating pressure line (100), a valve (128) is provided which upon overpressure in the crankcase (11) opens toward the adjusting device (90).

4. The fuel injection apparatus of claim 3, in which one or more throttles (129, 130) are disposed in the pulsating pressure line (100).

5. The fuel injection apparatus of claim 4, in which at least one of the throttles (129, 130) is embodied as pressure-controllable.

6. The fuel injection apparatus of claim 1, in which a compression spring (109) is provided in the adjusting device (90), its spring force being variable by a bimetallic element (107).

7. The fuel injection apparatus of claim 2, in which a pressure chamber (97) defined by the diaphragm (94) is connected via a pressure connection (104, 115) to an intake tube (9) of the two-stroke engine (4).

8. The fuel injection apparatus of claim 7, in which a starter device (105) is provided, which selectively makes a pressure connection of the pressure chamber (97) with either the pressure in the intake tube (9) or the ambient pressure.

* * * * *